US009210738B2

(12) United States Patent
Ward et al.

(10) Patent No.: US 9,210,738 B2
(45) Date of Patent: Dec. 8, 2015

(54) APPARATUS AND METHOD FOR WINDING A SUBSTANTIALLY CONTINUOUS HEATING ELEMENT ABOUT A SUBSTANTIALLY CONTINUOUS WICK

(71) Applicant: R. J. Reynolds Tobacco Company, Winston-Salem, NC (US)

(72) Inventors: Reeder N. Ward, Melbourne, FL (US); Kenneth D. White, Cocoa, FL (US); James Dean Davis, Melbourne Beach, FL (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 240 days.

(21) Appl. No.: 13/708,381

(22) Filed: Dec. 7, 2012

(65) Prior Publication Data

US 2014/0157583 A1 Jun. 12, 2014

(51) Int. Cl.
*H05B 3/00* (2006.01)
*A24F 47/00* (2006.01)

(52) U.S. Cl.
CPC ..... *H05B 3/00* (2013.01); *A24F 47/008* (2013.01); *Y10T 29/49083* (2015.01); *Y10T 29/5313* (2015.01)

(58) Field of Classification Search
CPC ..... H05B 3/10; H05B 3/60; A24F 47/008; Y10T 29/4902; Y10T 29/49082; Y10T 29/49085; Y10T 29/49096; Y10T 29/53091; Y10T 29/5313; Y10T 29/53187; Y10T 29/53265; Y10T 29/53365
USPC ..... 29/592.1, 611, 613, 618, 711, 721, 729, 29/742, 760
See application file for complete search history.

(56) References Cited

U.S. PATENT DOCUMENTS 3,574,931 A * 4/1971 Mochizuki et al. ..... 29/613
5,322,075 A 6/1994 Deevi et al.

(Continued)

FOREIGN PATENT DOCUMENTS

EP 2 404 515 1/2012
WO WO 03/034847 A1 5/2003

OTHER PUBLICATIONS

Anonymous; "Making an Atomizer Coil 101(Actual Working Methods Only)"; Jan. 25, 2010; retrieved from the internet: URL:http://www.e-cigarette-forum.com/forum/atomizer-mods/65250-making-atomizer-coil-101-actual-working-methods-only.html; retrieved on Mar. 17, 2014.

(Continued)

*Primary Examiner* — Paul D Kim
(74) *Attorney, Agent, or Firm* — Womble Carlyle Sandridge & Rice, LLP

(57) ABSTRACT

The present disclosure relates to apparatuses configured to pre-form atomizers. The apparatus may include wick and heating element supplies configured to respectively provide a substantially continuous wick and a substantially continuous heating element. A winding mechanism is configured to wind the heating element about the wick. An adjustment mechanism is configured to adjust a position at which the winding mechanism winds the heating element about the wick. Additionally a synchronization mechanism synchronizes winding the heating element about the wick with adjustment of the position at which the heating element is wound about the wick such that the heating element defines a coiled heating element segment wound about the wick. This process may be repeated to produce multiple coiled heating element segments wound about the wick. A related method is also provided.

23 Claims, 9 Drawing Sheets

(56) References Cited

U.S. PATENT DOCUMENTS

| | | | | |
|---|---|---|---|---|
| 5,353,813 | A | 10/1994 | Deevi et al. | |
| 5,372,148 | A | 12/1994 | McCafferty et al. | |
| 5,498,855 | A | 3/1996 | Deevi et al. | |
| 5,591,368 | A | 1/1997 | Fleischhauer et al. | |
| 5,613,505 | A | 3/1997 | Campbell et al. | |
| 5,659,656 | A | 8/1997 | Das | |
| 5,665,262 | A | 9/1997 | Hajaligol et al. | |
| 5,743,251 | A | 4/1998 | Howell et al. | |
| 5,934,289 | A | 8/1999 | Watkins et al. | |
| 6,040,560 | A | 3/2000 | Fleischhauer et al. | |
| 6,557,552 | B1 | 5/2003 | Cox et al. | |
| 6,766,220 | B2 | 7/2004 | McRae et al. | |
| 6,803,545 | B2 | 10/2004 | Blake et al. | |
| 6,854,461 | B2 | 2/2005 | Nichols et al. | |
| 6,923,179 | B2 | 8/2005 | Gupta et al. | |
| 6,994,096 | B2 | 2/2006 | Rostami et al. | |
| 7,040,314 | B2 | 5/2006 | Nguyen et al. | |
| 7,117,867 | B2 | 10/2006 | Cox et al. | |
| 7,147,170 | B2 | 12/2006 | Nguyen et al. | |
| 7,167,776 | B2 | 1/2007 | Maharajh et al. | |
| 7,173,222 | B2 | 2/2007 | Cox et al. | |
| 7,234,470 | B2 | 6/2007 | Yang | |
| 7,290,549 | B2 | 11/2007 | Banerjee et al. | |
| 7,293,565 | B2 | 11/2007 | Griffin et al. | |
| 7,400,940 | B2 | 7/2008 | McRae et al. | |
| 7,500,479 | B2 | 3/2009 | Nichols et al. | |
| 7,645,442 | B2 | 1/2010 | Hale et al. | |
| 7,726,320 | B2 | 6/2010 | Robinson et al. | |
| 7,810,505 | B2 | 10/2010 | Yang | |
| 7,832,410 | B2 | 11/2010 | Hon | |
| 7,845,359 | B2 | 12/2010 | Montaser | |
| 7,997,280 | B2 | 8/2011 | Rosenthal | |
| 8,003,080 | B2 | 8/2011 | Rabinowitz et al. | |
| 8,079,371 | B2 | 12/2011 | Robinson et al. | |
| 8,091,558 | B2 | 1/2012 | Martzel | |
| 8,127,772 | B2 | 3/2012 | Montaser | |
| 8,156,944 | B2 | 4/2012 | Han | |
| 8,191,555 | B2 * | 6/2012 | Herbrich et al. | 131/273 |
| 8,205,622 | B2 | 6/2012 | Pan | |
| 8,857,446 | B2 * | 10/2014 | Wu | 131/273 |
| 2009/0095312 | A1 | 4/2009 | Herbrich et al. | |
| 2009/0284338 | A1 * | 11/2009 | Maruyama et al. | 336/182 |
| 2011/0047957 | A1 * | 3/2011 | Richard | 57/236 |
| 2011/0303231 | A1 | 12/2011 | Li et al. | |
| 2012/0060853 | A1 | 3/2012 | Robinson et al. | |
| 2012/0145169 | A1 | 6/2012 | Wu | |
| 2013/0037041 | A1 | 2/2013 | Worm et al. | |
| 2013/0319435 | A1 * | 12/2013 | Flick | 131/328 |
| 2014/0007863 | A1 * | 1/2014 | Chen | 128/200.14 |

OTHER PUBLICATIONS

International Search Report and Written Opinion of the International Searching Authority for corresponding International Application No. PCT/US2013/071995 mailed Mar. 25, 2014.
U.S. Appl. No. 13/432,406, Mar. 28, 2012, Griffith, Jr.
U.S. Appl. No. 13/536,438, Jun. 28, 2012, Sebastian.
U.S. Appl. No. 13/602,871, Sep. 4, 2012, Collett.
U.S. Appl. No. 13/754,324, Jan. 30, 2013, Sears.
U.S. Appl. No. 13/802,950, Mar. 14, 2013, Chapman.
U.S. Appl. No. 13/827,994, Mar. 14, 2013, DePiano.
U.S. Appl. No. 13/837,542, Mar. 15, 2013, Ampolini.
U.S. Appl. No. 13/840,264, Mar. 15, 2013, Novak, III.
U.S. Appl. No. 13/841,233, Mar. 15, 2013, DePiano.
U.S. Appl. No. 13/842,125, Mar. 15, 2013, DePiano.

* cited by examiner

APPARATUS AND METHOD FOR WINDING A SUBSTANTIALLY CONTINUOUS HEATING ELEMENT ABOUT A SUBSTANTIALLY CONTINUOUS WICK

FIELD OF THE DISCLOSURE

The present disclosure relates to atomizers for smoking articles, and more particularly to apparatuses and methods for pre-forming atomizers for smoking articles. The atomizers may be configured to heat a material, which may be made or derived from tobacco or otherwise incorporate tobacco, to form an inhalable substance for human consumption.

BACKGROUND

Many smoking devices have been proposed through the years as improvements upon, or alternatives to, smoking products that require combusting tobacco for use. Many of those devices purportedly have been designed to provide the sensations associated with cigarette, cigar, or pipe smoking, but without delivering considerable quantities of incomplete combustion and pyrolysis products that result from the burning of tobacco. To this end, there have been proposed numerous smoking products, flavor generators, and medicinal inhalers that utilize electrical energy to vaporize or heat a volatile material, or attempt to provide the sensations of cigarette, cigar, or pipe smoking without burning tobacco to a significant degree. See, for example, the various alternative smoking articles, aerosol delivery devices and heat generating sources set forth in the background art described in U.S. Pat. No. 7,726,320 to Robinson et al., U.S. patent application Ser. No. 13/432,406, filed Mar. 28, 2012, U.S. patent application Ser. No. 13/536,438, filed Jun. 28, 2012, U.S. patent application Ser. No. 13/602,871, filed Sep. 4, 2012, and U.S. patent application Ser. No. 13/647,000, filed Oct. 8, 2012, which are incorporated herein by reference.

Certain tobacco products that have employed electrical energy to produce heat for smoke or aerosol formation, and in particular, certain products that have been referred to as electronic cigarette products, have been commercially available throughout the world. Representative products that resemble many of the attributes of traditional types of cigarettes, cigars or pipes have been marketed as ACCORD® by Philip Morris Incorporated; ALPHA™, JOYE 510™ and M4™ by InnoVapor LLC; CIRRUS™ and FLING™ by White Cloud Cigarettes; COHITA™, COLIBRI™, ELITE CLASSIC™, MAGNUM™, PHANTOM™ and SENSE™ by Epuffer® International Inc.; DUOPRO™, STORM™ and VAPORKING® by Electronic Cigarettes, Inc.; EGAR™ by Egar Australia; eGo-C™ and eGo-T™ by Joyetech; ELUSION™ by Elusion UK Ltd; EONSMOKE® by Eonsmoke LLC; GREEN SMOKE® by Green Smoke Inc. USA; GREENARETTE™ by Greenarette LLC; HALLIGAN™, HENDU™, JET™, MAXXQ™, PINK™ and PITBULL™ by Smoke Stik®; HEATBAR™ by Philip Morris International, Inc.; HYDRO IMPERIAL™ and LXE™ from Crown7; LOGIC™ and THE CUBAN™ by LOGIC Technology; LUCI® by Luciano Smokes Inc.; METRO® by Nicotek, LLC; NJOY® and ONEJOY™ by Sottera, Inc.; NO. 7™ by SS Choice LLC; PREMIUM ELECTRONIC CIGARETTE™ by PremiumEstore LLC; RAPP E-MYSTICK™ by Ruyan America, Inc.; RED DRAGON™ by Red Dragon Products, LLC; RUYAN® by Ruyan Group (Holdings) Ltd.; SMART SMOKER® by The Smart Smoking Electronic Cigarette Company Ltd.; SMOKE ASSIST® by Coastline Products LLC; SMOKING EVERYWHERE® by Smoking Everywhere, Inc.; V2CIGS™ by VMR Products LLC; VAPOR NINE™ by VaporNine LLC; VAPOR4LIFE® by Vapor 4 Life, Inc.; VEPPO™ by E-CigaretteDirect, LLC and VUSE® by R. J. Reynolds Vapor Company. Yet other electrically powered aerosol delivery devices, and in particular those devices that have been characterized as so-called electronic cigarettes, have been marketed under the tradenames BLU™; COOLER VISIONS™; DIRECT E-CIG™; DRAGONFLY™; EMIST™; EVERSMOKE™; GAMUCCI®; HYBRID FLAME™; KNIGHT STICKS™; ROYAL BLUES™; SMOKETIP® and SOUTH BEACH SMOKE™.

It would be desirable to provide a smoking article that employs heat produced by electrical energy to provide the sensations of cigarette, cigar, or pipe smoking, that does so without combusting tobacco to any significant degree, that does so without the need of a combustion heat source, and that does so without necessarily delivering considerable quantities of incomplete combustion and pyrolysis products. Thus, advances with respect to manufacturing electronic smoking articles may be desirable.

BRIEF SUMMARY

In one aspect an apparatus configured to pre-form an atomizer is provided. The apparatus may comprise a wick supply configured to provide a substantially continuous wick and a heating element supply configured to provide a substantially continuous heating element. Further, the apparatus may include a winding mechanism configured to wind the substantially continuous heating element about the substantially continuous wick. The apparatus may additionally include an adjustment mechanism configured to adjust a position at which the winding mechanism winds the substantially continuous heating element about the substantially continuous wick. Additionally, the apparatus may include a synchronization mechanism configured to synchronize winding the substantially continuous heating element about the substantially continuous wick with adjustment of the position at which the substantially continuous heating element is wound about the substantially continuous wick such that the substantially continuous heating element defines a coiled heating element segment wound about the substantially continuous wick.

In some embodiments the apparatus may further comprise a cutting mechanism configured to cut the substantially continuous heating element to define a resistive heating element comprising the coiled heating element segment. The apparatus may also include a collection reel configured to collect the substantially continuous wick with the resistive heating element wound thereon. Additionally, the apparatus may include a heating element feeder configured to position the substantially continuous heating element in proximity to the substantially continuous wick. The heating element feeder may comprise a hollow needle. The heating element feeder may be moveable toward and away from the substantially continuous wick.

In some embodiments the winding mechanism, the adjustment mechanism, and the synchronization mechanism are operably engaged with a hand crank, a motor, or a similar rotational power component. The winding mechanism may comprise a winding head configured to rotate about a rotational axis. The winding head may define a hole therethrough extending along the rotational axis through which the substantially continuous wick is received. The winding head may comprise an engagement mechanism configured to releasably engage the substantially continuous heating element proximate an end thereof. The engagement mechanism may comprise a notch defined in the winding head. The apparatus may further comprise a tensioning mechanism configured to tension the substantially continuous wick proximate the winding mechanism. The adjustment mechanism may comprise a sliding carriage configured for displacement with respect to the substantially continuous wick.

In another aspect a method for pre-forming an atomizer is provided. The method may comprise providing a substantially continuous wick and providing a substantially continuous heating element. The method may also include winding the substantially continuous heating element about the substantially continuous wick. Further, the method may include adjusting a position at which the substantially continuous heating element is wound about the substantially continuous wick. Additionally, the method may include synchronizing winding the substantially continuous heating element about the substantially continuous wick with adjustment of the position at which the substantially continuous heating element is wound about the substantially continuous wick such that the substantially continuous heating element defines a coiled heating element segment wound about the substantially continuous wick.

In some embodiments the method may further comprise cutting the substantially continuous heating element to define a resistive heating element comprising the coiled heating element segment. The method may additionally include incrementing a starting winding position on the substantially continuous wick. The substantially continuous heating element may be supplied at a position that is stationary with respect to the substantially continuous wick. The method may further comprise collecting the substantially continuous wick with the resistive heating element wound thereon on a collection reel. The method may also include directing the substantially continuous wick through a hole extending along a rotational axis of a winding head. Further, winding the substantially continuous heating element about the substantially continuous wick may comprise releasably engaging the substantially continuous heating element proximate an end thereof with the winding head.

BRIEF DESCRIPTION OF THE FIGURES

Figure 1:
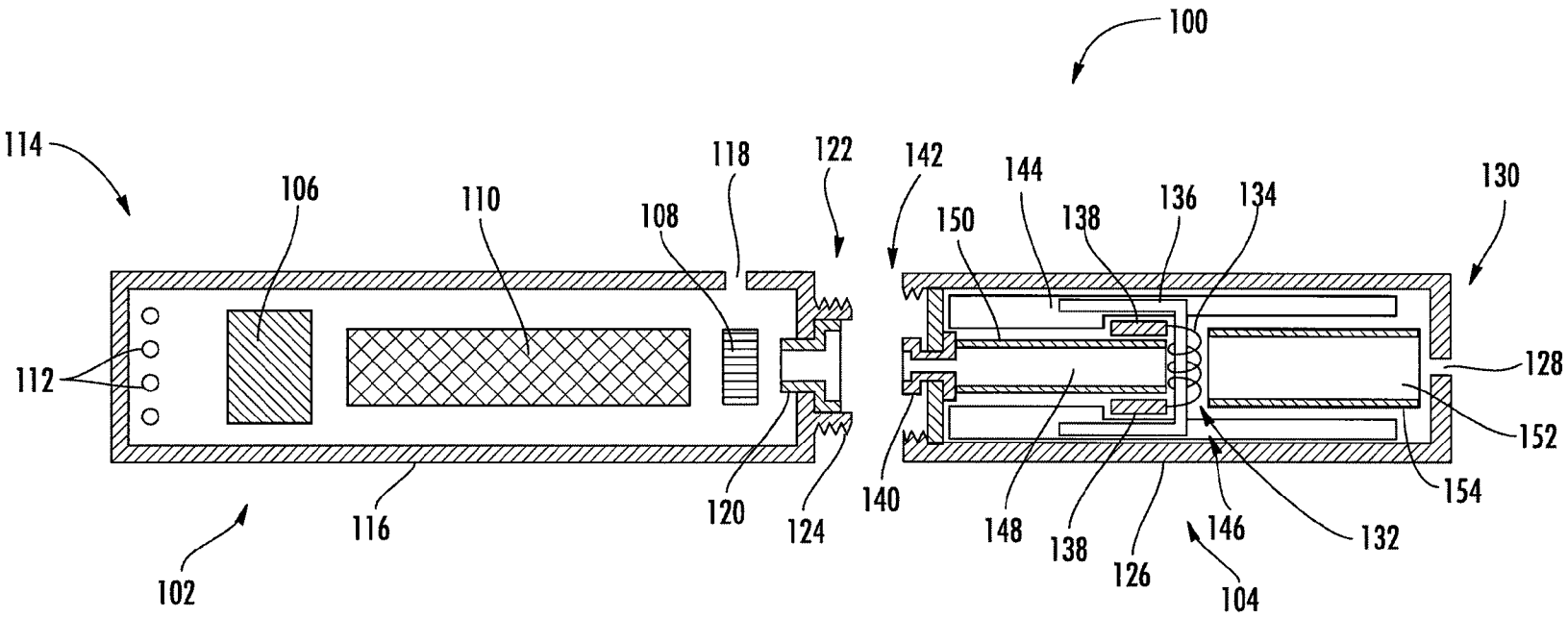
Figure 2:
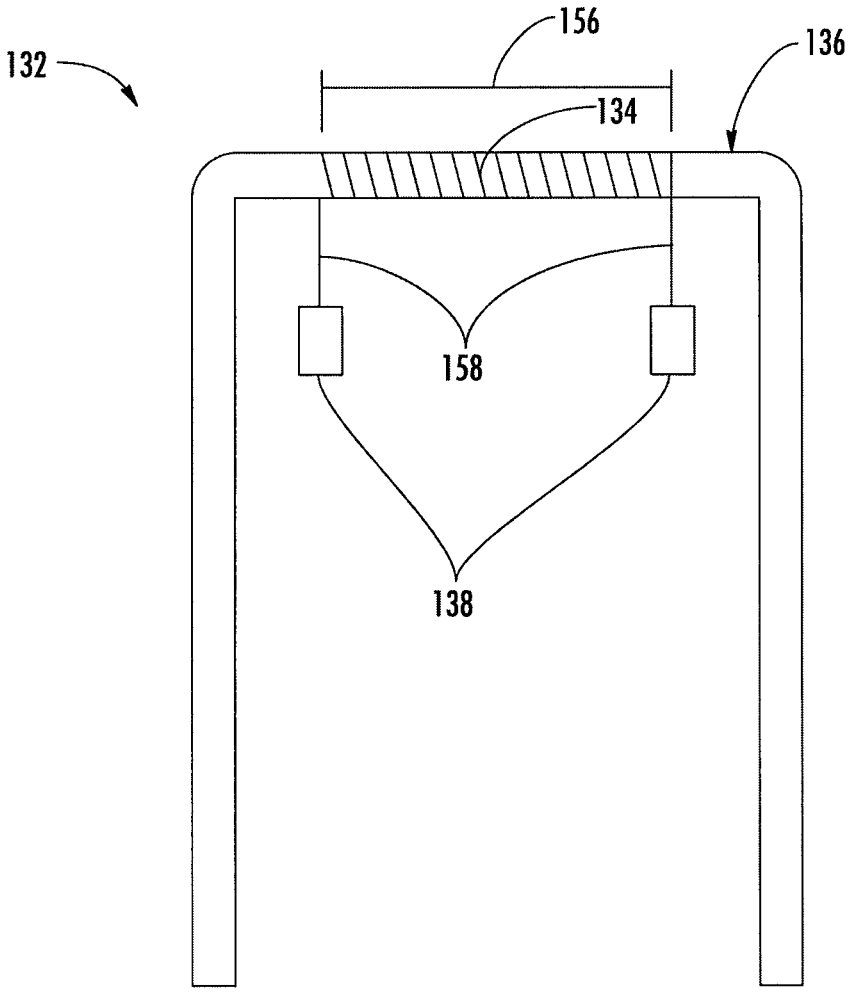
Figure 3:
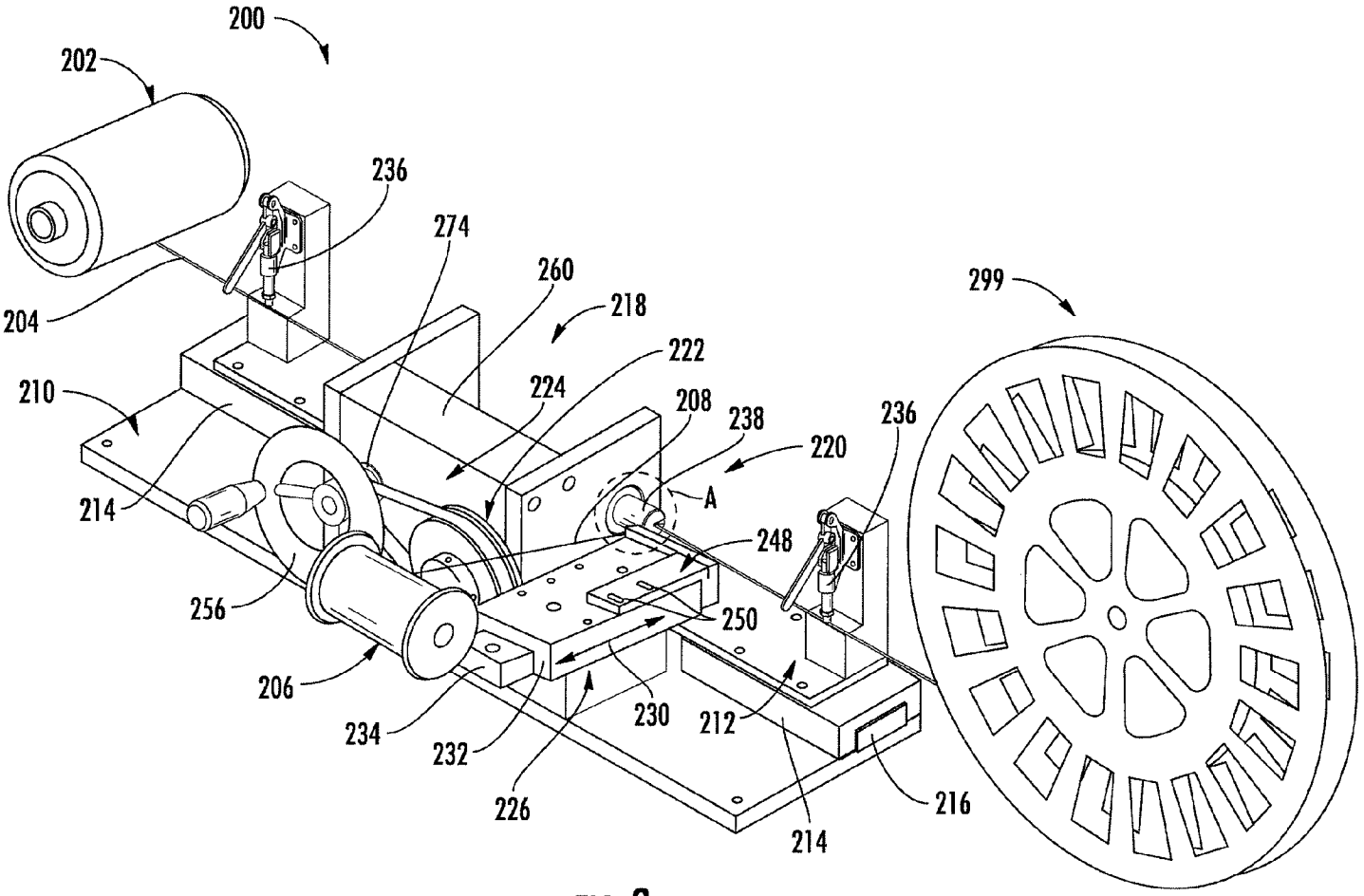
Figure 4:
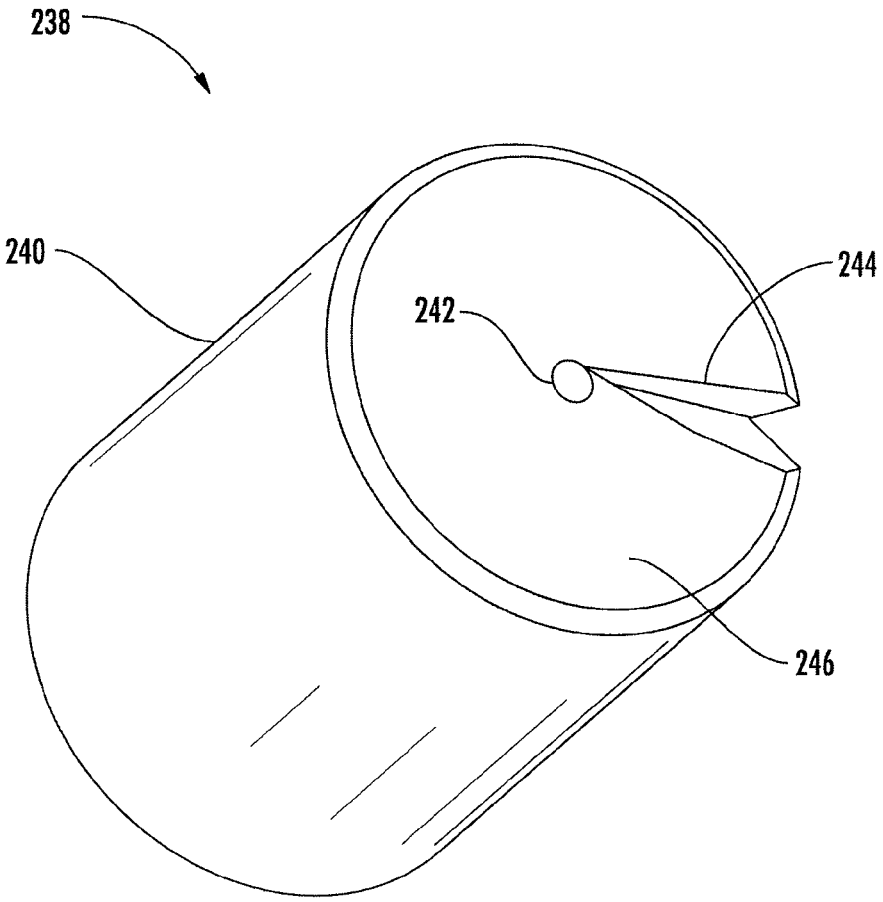
Figure 5:
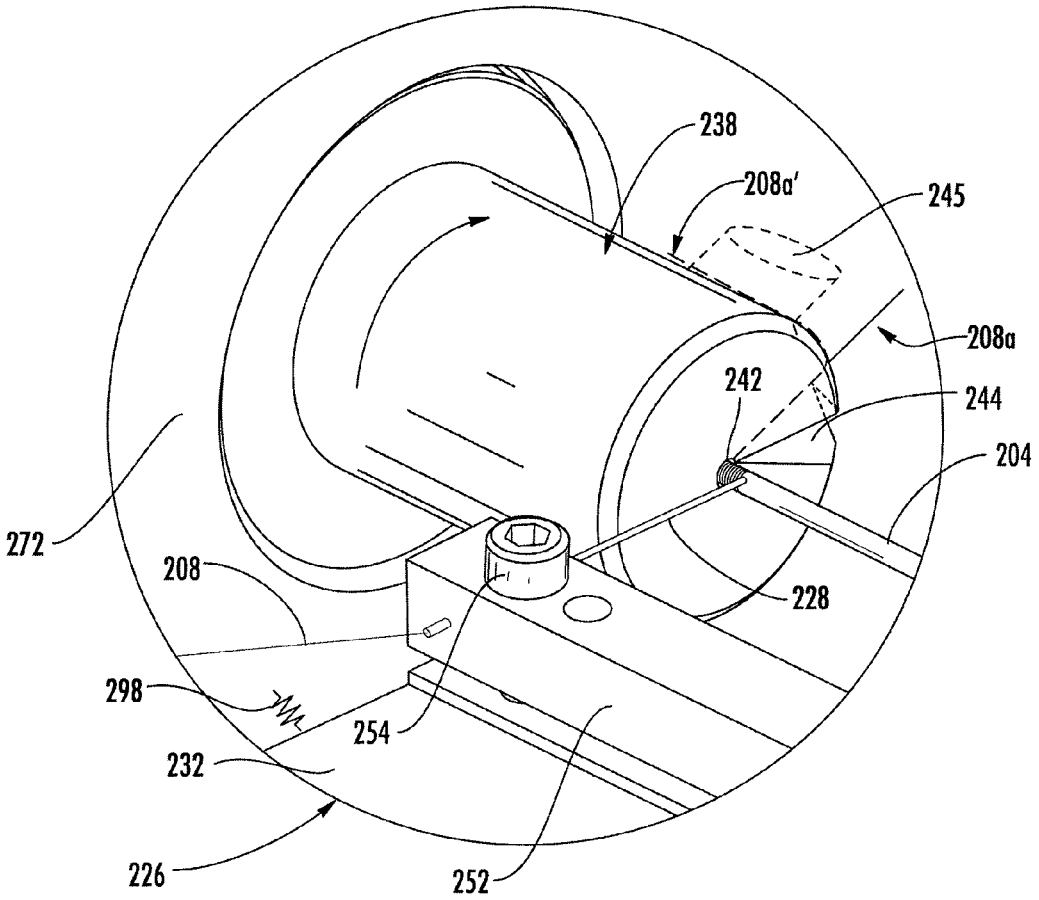
Figure 6:
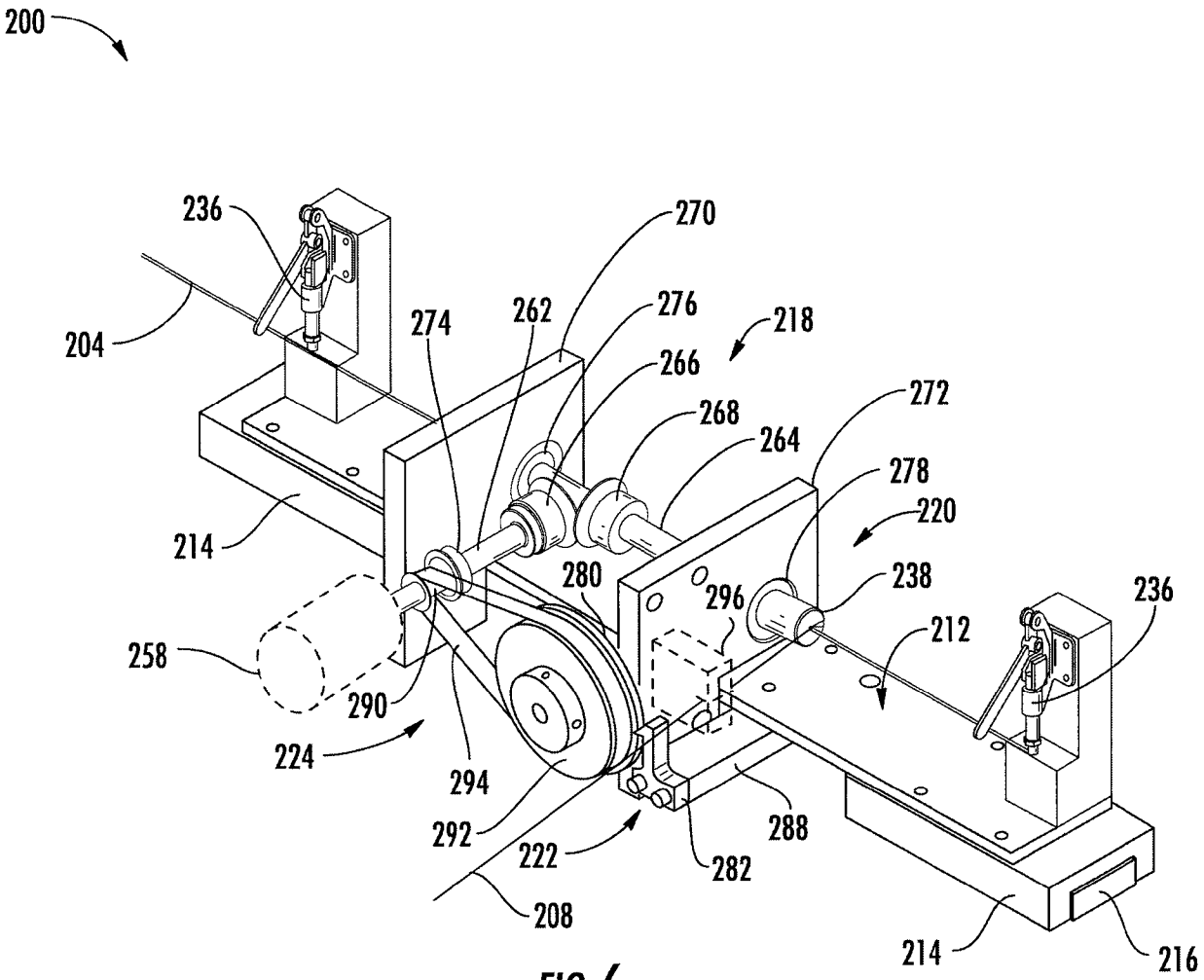
Figure 7:
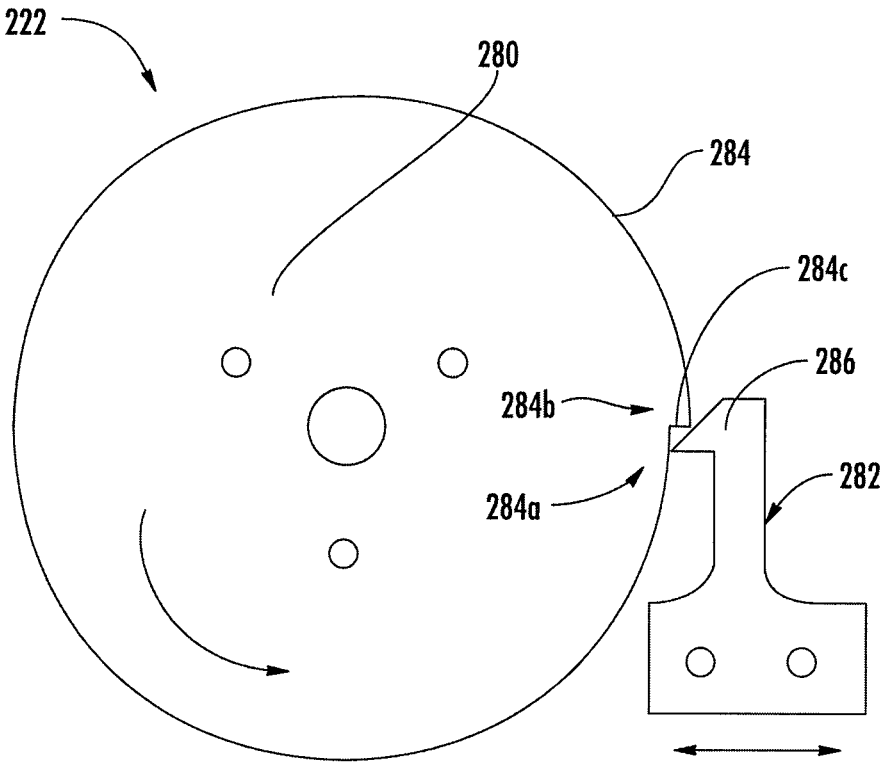
Figure 8:
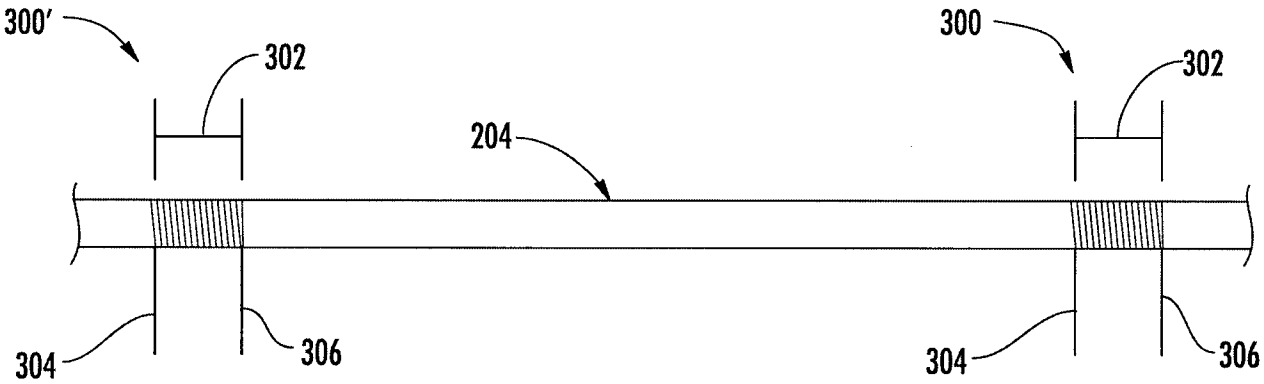
Figure 9:
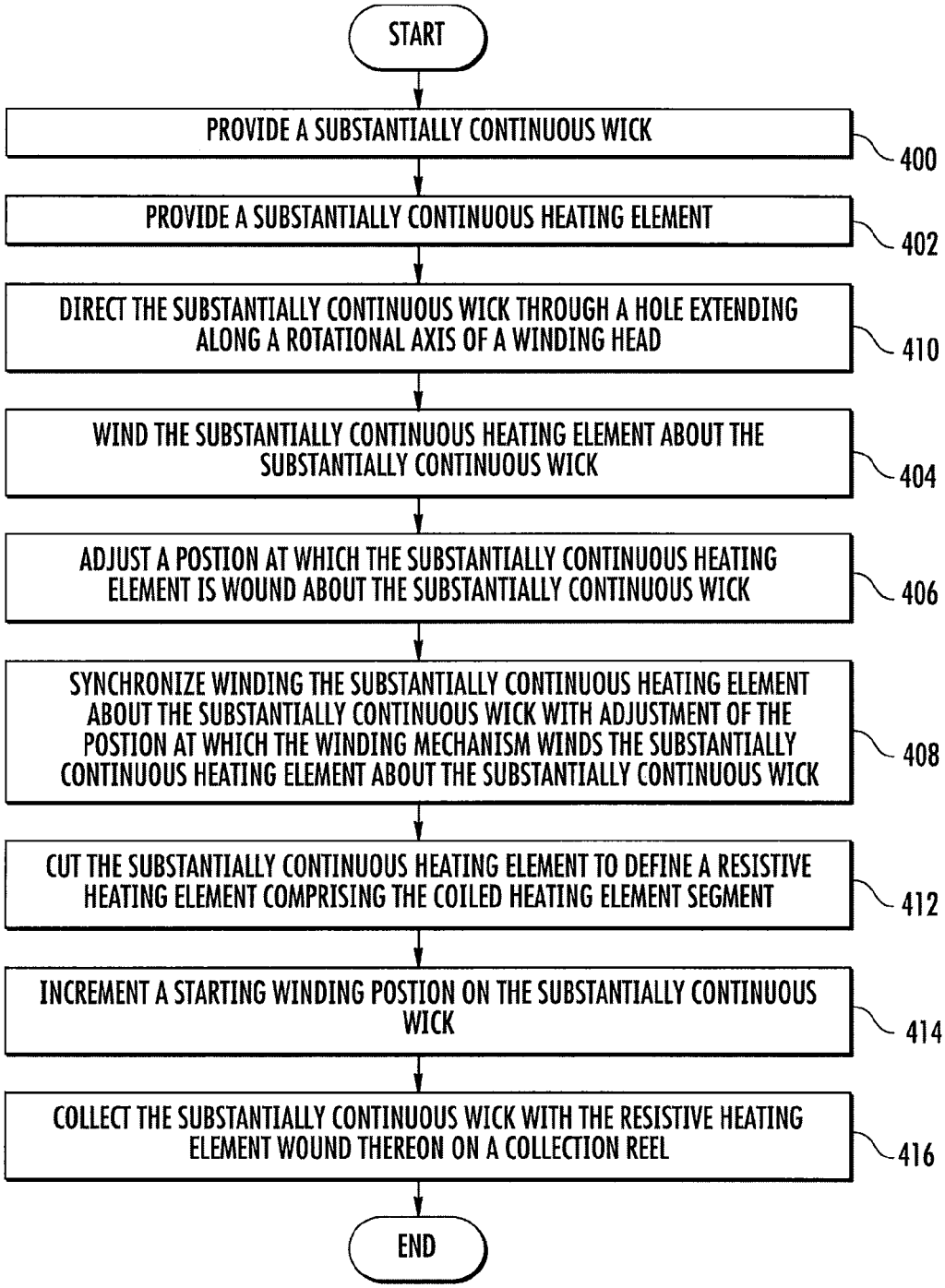

Having thus described the disclosure in the foregoing general terms, reference will now be made to the accompanying drawings, which are not necessarily drawn to scale, and wherein:

FIG. 1 illustrates a sectional view through an embodiment of a smoking article comprising a control body and a cartridge including an atomizer according to an embodiment of the present disclosure;

FIG. 2 illustrates a view of the atomizer of the smoking article of FIG. 1;

FIG. 3 illustrates a perspective view of an apparatus configured to pre-form an atomizer comprising a winding mechanism, an adjustment mechanism and a synchronization mechanism according to an example embodiment of the present disclosure;

FIG. 4 illustrates a perspective view of a winding head of the winding mechanism of FIG. 1 in isolation;

FIG. 5 illustrates a perspective view of the winding head of FIG. 4 in a starting configuration;

FIG. 6 illustrates a partial perspective view of the apparatus of FIG. 3;

FIG. 7 illustrates a cam and a follower of the adjustment mechanism of the apparatus of FIG. 3;

FIG. 8 illustrates pre-formed atomizers comprising a substantially continuous wick and a plurality of coiled heating element segments wound thereon according to an example embodiment of the present disclosure; and FIG. 9 illustrates a schematic view of a method for pre-forming atomizers according to an example embodiment of the present disclosure.

DETAILED DESCRIPTION

The present disclosure will now be described more fully hereinafter with reference to exemplary embodiments thereof. These exemplary embodiments are described so that this disclosure will be thorough and complete, and will fully convey the scope of the disclosure to those skilled in the art. Indeed, the present disclosure may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The present disclosure relates to articles (and the manufacture thereof) that use electrical energy to heat a material (preferably without combusting the material to any significant degree) to form an inhalable substance, the articles being sufficiently compact to be considered "hand-held" devices. In certain embodiments, the articles can particularly be characterized as smoking articles. As used herein, the term "smoking article" is intended to mean an article that provides many of the sensations (e.g., inhalation and exhalation rituals, types of tastes or flavors, organoleptic effects, physical feel, use rituals, visual cues such as those provided by visible aerosol, and the like) of smoking a cigarette, cigar, or pipe without any substantial degree of combustion of any component of the article. As used herein, the term "smoking article" does not necessarily mean that, in operation, the article produces smoke in the sense of the aerosol resulting from by-product of combustion or pyrolysis of tobacco, but rather, that the article yields vapors (including vapors within aerosols that can be considered to be visible aerosols that might be considered to be described as smoke-like) resulting from volitization or vaporization of certain components of the article or device." In highly preferred embodiments, articles characterized as smoking articles incorporate tobacco and/or components derived from tobacco.

In further embodiments, the articles that can be manufactured according to the present disclosure can be characterized as being vapor-producing articles, aerosolization articles, or medicament delivery articles. Thus, the articles can be arranged so as to provide one or more substances (e.g., flavors and/or pharmaceutical active ingredients) in an inhalable form or state. For example, inhalable substances can be substantially in the form of a vapor (i.e., a substance that is in the gas phase at a temperature lower than its critical point). Alternatively, inhalable substances can be in the form of an aerosol (i.e., a suspension of fine solid particles or liquid droplets in a gas). For purposes of simplicity, the term "aerosol" as used herein is meant to include vapors, gases and aerosols of a form or type suitable for human inhalation, whether or not visible, and whether or not of a form that might be considered to be smoke-like.

In use, smoking articles that can be manufactured according to the present disclosure may be subjected to many of the physical actions of an individual in using a traditional type of smoking article (e.g., a cigarette, cigar or pipe that is employed by lighting with a flame and used by inhaling tobacco that is subsequently burned). For example, the user of a smoking article of the present invention can hold that article much like a traditional type of smoking article, draw on one end of that article for inhalation of aerosol produced by that article, take puffs at selected intervals of time.

A smoking article that can be manufactured according to one aspect of the present disclosure can include a number of components provided within an outer shell or body. The overall design of the outer shell or body can vary, and the format or configuration of the outer body that can define the overall size and shape of the smoking article can vary. Typically, an elongated body resembling shape of a cigarette or cigar can be a formed from a single, unitary shell; or the elongated body can be formed of two or more separable pieces. For example, a smoking article can comprise an elongated shell or body that can be substantially tubular in shape, and as such, resemble the shape of a conventional cigarette or cigar. In one embodiment, all of the components of the smoking article are contained within one outer body or shell. Alternatively, a smoking article can comprise two shells that are joined and are separable. For example, a smoking article can possess at one end a control body comprising a shell containing one or more reusable components (e.g., a rechargeable battery and various electronics for controlling the operation of that article), and at the other end and removably attached thereto a shell containing a disposable portion (e.g., a disposable flavor-containing cartridge). Additionally, various smoking article designs and component arrangements can be appreciated upon consideration of the commercially available electronic smoking articles, such as those representative products listed in the background art section of the present disclosure.

A smoking article that can be manufactured according to one aspect of the present disclosure can include some combination of power source (i.e., an electrical power source), at least one control component (e.g., means for actuating, controlling, regulating and ceasing power for heat generation, such as by controlling electrical current flow the power source to other components of the article), a heater or heat generation component (e.g., an electrical resistance heating element or component commonly referred to as an "atomizer"), and an aerosol precursor component (e.g., commonly a liquid capable of yielding an aerosol upon application of sufficient heat, such as ingredients commonly referred to as "smoke juice," "e-liquid" and "e-juice"), and a mouthend region or tip for allowing draw upon the smoking article for aerosol inhalation (e.g., a defined air flow path through the article such that aerosol generated can be withdrawn therefrom upon draw). Alignment of the components within the article can vary. In specific embodiments, the aerosol precursor component can be located near an end of the article (e.g., with a cartridge, which in certain circumstances can be replaceable and disposable) that is proximal to the mouth of a user so as to maximize aerosol delivery to the user. Other configurations, however, are not excluded. Generally, the heater component can be positioned sufficiently near that aerosol precursor component so that heat from the heater component can volatilize the aerosol precursor (as well as one or more flavorants, medicaments, or the like that may likewise be provided for delivery to a user) and form an aerosol for delivery to the user. When the heating member heats the aerosol precursor component, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof. Additionally, the selection of various smoking article components can be appreciated upon consideration of the commercially available electronic smoking articles, such as those representative products listed in the background art section of the present disclosure.

A smoking article that can be manufactured according to one aspect of the present disclosure can include may incorporate a battery or other electrical power source to provide current flow sufficient to provide various functionalities to the article, such as resistive heating, powering of control systems, powering of indicators, and the like. The power source can take on various embodiments. Preferably, the power source is able to deliver sufficient power to rapidly heat the heating member to provide for aerosol formation and power the article through use for the desired duration of time. The power source preferably is sized to fit conveniently within the article so that the article can be easily handled; and additionally, preferred a preferred power source is of a sufficiently light weight to not detract from a desirable smoking experience.

An exemplary smoking article 100 according to the disclosure is shown in FIG. 1. As seen in the cross-section illustrated therein, the smoking article 100 can comprise a control body 102 and a cartridge 104 that can be permanently or detachably aligned in a functioning relationship. Although a threaded engagement is illustrated in FIG. 1, it is understood that further means of engagement are encompassed, such as a press-fit engagement, a magnetic engagement, or the like.

In specific embodiments, one or both of the control body 102 and the cartridge 104 may be referred to as being disposable or as being reusable. For example, the control body may have a replaceable battery or may be rechargeable and thus may be combined with any type of recharging technology, including connection to a typical electrical outlet, connection to a car charger (i.e., cigarette lighter receptacle), and connection to a computer, such as through a USB cable.

In the exemplified embodiment, the control body 102 includes a control component 106, a flow sensor 108, and a battery 110, which can be variably aligned, and can include a plurality of indicators 112 at a distal end 114 of a shell 116. The indicators 112 can be provided in varying numbers and can take on different shapes and can even be an opening in the body (such as for release of sound when such indicators are present).

An air intake 118 may be positioned in the shell 116 of the control body 102. A receptacle 120 also is included at the proximal attachment end 122 of the control body 102 and extends into a control body projection 124 to allow for ease of electrical connection with a an atomizer or a component thereof, such as a resistive heating element (described below) when the cartridge 104 is attached to the control body.

The cartridge 104 includes a shell 126 with a mouth opening 128 at a mouthend 130 thereof to allow passage of air and entrained vapor (i.e., the components of the aerosol precursor composition in an inhalable form) from the cartridge to a consumer during draw on the smoking article 100. The smoking article 100 may be substantially rod-like or substantially tubular shaped or substantially cylindrically shaped.

The cartridge 104 further includes an atomizer 132 comprising a resistive heating element 134 in the form of a metal wire coil and a wick 136. The resistive heating element 134 includes terminals 138 (e.g., positive and negative terminals) at the opposing ends thereof for facilitating current flow through the resistive heating element and for attachment to the appropriate wiring (not illustrated) to form an electrical connection of the resistive heating element with the battery 110 when the cartridge 104 is connected to the control body 102. Specifically, a plug 140 may be positioned at a distal attachment end 142 of the cartridge 104. When the cartridge 104 is connected to the control body 102, the plug 140 engages the receptacle 120 to form an electrical connection such that current controllably flows from the battery 110, through the receptacle and plug, and to the resistive heating element 134. The shell 126 of the cartridge 104 can continue across the distal attachment end such that this end of the cartridge is substantially closed with the plug protruding therefrom.

A reservoir may utilize a transport element to transport an aerosol precursor composition to an aerosolization zone. One such example is shown in FIG. 1. As seen therein, the cartridge 104 includes a reservoir layer 144 comprising layers of nonwoven fibers formed into the shape of a tube encircling the interior of the shell 126 of the cartridge, in this embodiment. An aerosol precursor composition is retained in the reservoir layer 144. Liquid components, for example, can be sorptively retained by the reservoir layer 144. The reservoir layer 144 is in fluid connection with a transport element (the wick in this embodiment). The wick 136 transports the aerosol precursor composition stored in the reservoir layer 144 via capillary action to an aerosolization zone 146 of the cartridge 104. As illustrated, the wick 136 is in direct contact with the resistive heating element 134 that is in the form of a metal wire coil in this embodiment.

In use, when a user draws on the article 100, the resistive heating element 134 is activated (e.g., such as via a puff sensor), and the components for the aerosol precursor composition are vaporized in the aerosolization zone 146. Drawing upon the mouthend 130 of the article 100 causes ambient air to enter the air intake 118 and pass through the central opening in the receptacle 120 and the central opening in the plug 140. In the cartridge 104, the drawn air passes through an air passage 148 in an air passage tube 150 and combines with the formed vapor in the aerosolization zone 146 to form an aerosol. The aerosol is whisked away from the aerosolization zone, passes through an air passage 152 in an air passage tube 154, and out the mouth opening 128 in the mouthend 130 of the article 100.

It is understood that a smoking article that can be manufactured according to the present disclosure can encompass a variety of combinations of components useful in forming an electronic smoking article. Reference is made for example to the smoking articles disclosed in U.S. patent application Ser. No. 13/536,438, filed Jun. 28, 2012, U.S. patent application Ser. No. 13/432,406, filed Mar. 28, 2012, U.S. patent application Ser. No. 13/602,871, filed Sep. 4, 2012, the disclosures of which are incorporated herein by reference in their entirety. Further to the above, representative heating elements and materials for use therein are described in U.S. Pat. No. 5,060,671 to Counts et al.; U.S. Pat. No. 5,093,894 to Deevi et al.; U.S. Pat. No. 5,224,498 to Deevi et al.; U.S. Pat. No. 5,228,460 to Sprinkel Jr., et al.; U.S. Pat. No. 5,322,075 to Deevi et al.; U.S. Pat. No. 5,353,813 to Deevi et al.; U.S. Pat. No. 5,468,936 to Deevi et al.; U.S. Pat. No. 5,498,850 to Das; U.S. Pat. No. 5,659,656 to Das; U.S. Pat. No. 5,498,855 to Deevi et al.; U.S. Pat. No. 5,530,225 to Hajaligol; U.S. Pat. No. 5,665,262 to Hajaligol; U.S. Pat. No. 5,573,692 to Das et al.; and U.S. Pat. No. 5,591,368 to Fleischhauer et al., the disclosures of which are incorporated herein by reference in their entireties. A single-use cartridge for use with an electronic smoking article is disclosed in U.S. patent application Ser. No. 13/603,612, filed Sep. 5, 2012, which is incorporated herein by reference in its entirety.

The various components of a smoking article according to the present invention can be chosen from components described in the art and commercially available. Examples of batteries that can be used according to the disclosure are described in U.S. Pat. App. Pub. No. 2010/0028766, the disclosure of which is incorporated herein by reference in its entirety.

An exemplary mechanism that can provide puff-actuation capability includes a Model 163PC01D36 silicon sensor, manufactured by the MicroSwitch division of Honeywell, Inc., Freeport, Ill. Further examples of demand-operated electrical switches that may be employed in a heating circuit according to the present disclosure are described in U.S. Pat. No. 4,735,217 to Gerth et al., which is incorporated herein by reference in its entirety. Further description of current regulating circuits and other control components, including microcontrollers, that can be useful in the present smoking article are provided in U.S. Pat. Nos. 4,922,901, 4,947,874, and 4,947,875, all to Brooks et al., U.S. Pat. No. 5,372,148 to McCafferty et al., U.S. Pat. No. 6,040,560 to Fleischhauer et al., and U.S. Pat. No. 7,040,314 to Nguyen et al., all of which are incorporated herein by reference in their entireties.

The aerosol precursor, which may also be referred to as a vapor precursor composition, can comprise one or more different components. For example, the aerosol precursor can include a polyhydric alcohol (e.g., glycerin, propylene glycol, or a mixture thereof). Representative types of further aerosol precursor compositions are set forth in U.S. Pat. No. 4,793,365 to Sensabaugh, Jr. et al.; U.S. Pat. No. 5,101,839 to Jakob et al.; PCT WO 98/57556 to Biggs et al.; and Chemical and Biological Studies on New Cigarette Prototypes that Heat Instead of Burn Tobacco, R. J. Reynolds Tobacco Company Monograph (1988); the disclosures of which are incorporated herein by reference.

Still further components can be utilized in the smoking article of the present disclosure. For example, U.S. Pat. No. 5,261,424 to Sprinkel, Jr. discloses piezoelectric sensors that can be associated with the mouth-end of a device to detect user lip activity associated with taking a draw and then trigger heating; U.S. Pat. No. 5,372,148 to McCafferty et al. discloses a puff sensor for controlling energy flow into a heating load array in response to pressure drop through a mouthpiece; U.S. Pat. No. 5,967,148 to Harris et al. discloses receptacles in a smoking device that include an identifier that detects a non-uniformity in infrared transmissivity of an inserted component and a controller that executes a detection routine as the component is inserted into the receptacle; U.S. Pat. No. 6,040,560 to Fleischhauer et al. describes a defined executable power cycle with multiple differential phases; U.S. Pat. No. 5,934,289 to Watkins et al. discloses photonic-optronic components; U.S. Pat. No. 5,954,979 to Counts et al. discloses means for altering draw resistance through a smoking device; U.S. Pat. No. 6,803,545 to Blake et al. discloses specific battery configurations for use in smoking devices; U.S. Pat. No. 7,293,565 to Griffen et al. discloses various charging systems for use with smoking devices; U.S. 2009/0320863 by Fernando et al. discloses computer interfacing means for smoking devices to facilitate charging and allow computer control of the device; U.S. 2010/0163063 by Fernando et al. discloses identification systems for smoking devices; and WO 2010/003480 by Flick discloses a fluid flow sensing system indicative of a puff in an aerosol generating system; all of the foregoing disclosures being incorporated herein by reference in their entireties. Further examples of components related to electronic aerosol delivery articles and disclosing materials or components that may be used in the present article include U.S. Pat. No. 4,735,217 to Gerth et al.; U.S. Pat. No. 5,249,586 to Morgan et al.; U.S. Pat. No. 5,666,977 to Higgins et al.; U.S. Pat. No. 6,053,176 to Adams et al.; U.S. Pat. No. 6,164,287 to White; U.S. Pat. No. 6,196,218 to Voges; U.S. Pat. No. 6,810,883 to Felter et al.; U.S. Pat. No.

6,854,461 to Nichols; U.S. Pat. No. 7,832,410 to Hon; U.S. Pat. No. 7,513,253 to Kobayashi; U.S. Pat. No. 7,896,006 to Hamano; U.S. Pat. No. 6,772,756 to Shayan; U.S. Pat. No. 8,156,944 to Hon; U.S. Pat. App. Pub. Nos. 2006/0196518, 2009/0126745, and 2009/0188490 to Hon; U.S. Pat. App. Pub. No. 2009/0272379 to Thorens et al.; U.S. Pat. App. Pub. Nos. 2009/0260641 and 2009/0260642 to Monsees et al.; U.S. Pat. App. Pub. Nos. 2008/0149118 and 2010/0024834 to Oglesby et al.; U.S. Pat. App. Pub. No. 2010/0307518 to Wang; and WO 2010/091593 to Hon. A variety of the materials disclosed by the foregoing documents may be incorporated into the present devices in various embodiments, and all of the foregoing disclosures are incorporated herein by reference in their entireties.

As described above, many embodiments of smoking articles may include an atomizer. For example, FIG. 2 illustrates an enlarged view of the atomizer 132 of the smoking article 100 illustrated in FIG. 1. As further described above, the atomizer 132 may comprise the wick 136 and the resistive heating element 134.

In one embodiment the resistive heating element 134 may comprise a NiChrome wire, although various other materials which resistively create heat when current is applied therethrough may be employed. Further, in some embodiments the resistive heating element 134 may define a diameter from about 0.005 inches to about 0.008 inches. However, other diameters may be employed in other embodiments depending upon the desired heating characteristics of the resistive heating element.

Further, in some embodiments the wick 136 may comprise various materials configured to transport a fluid (e.g., through capillary action). Non-limiting examples include natural and synthetic fibers, such as cotton, cellulose, polyesters, polyamides, polylactic acids, glass fibers, combinations thereof, and the like. In some embodiments a fiberglass cord may comprise a plurality of fiberglass filaments defining a diameter from about 9 microns to about 10 microns. The filaments may be twisted and/or woven together in any of a variety of patterns to form the fiberglass cord. The overall diameter of the fiberglass cord may be from about 1 millimeter to about 2 millimeters. However, various other embodiments of materials and sizes thereof may be employed in other embodiments.

In assembled form, the resistive heating element 134 may define a coiled heating element segment 156 and leads 158 extending from the ends thereof. As illustrated, the leads 158 may couple to the terminals 138. As further illustrated in FIG. 2, the resistive heating element 156 may be coiled around the wick 136 such that the resistive heating element 134 surrounds a portion of the wick.

However, creation of the coiled heating element segment 156 may be challenging. In this regard, it may be desirable to helically wrap the resistive heating element 134 about the wick 136 in order to evenly heat the portion of the wick about which the coiled heating element segment 156 is coiled. Accordingly, aerosolization of the substance provided to the resistive heating element 156 by the wick 136 may result in release of a desired quantity of aerosol. However, producing the atomizers 132 may be difficult. As noted above, the resistive heating element 134 may define a relatively small gauge, which may make handling the resistive heating element difficult. Additionally, individual segments of wick and/or individual segments of the material defining the resistive heating element may be employed to produce the atomizers. As a result of the relatively short length of these segments, and the relatively small gauge thereof, these segments may be difficult to handle. Further, the formation of equally spaced coils in a helical configuration may require a relatively high degree of precision. Further, handling and wrapping individual segments of the resistive heating element 134 and the wick 136 may be difficult. Thus, the production of atomizers 132 may be slow, imprecise, and/or costly. Accordingly, Applicants have determined that improvements in methods and apparatuses employed to produce atomizers may be desirable.

In this regard, FIG. 3 illustrates an embodiment of an apparatus 200 configured to pre-form atomizers. Pre-forming atomizers, as used herein, refers to performing one or more steps to at least partially form atomizers. In this regard, the pre-forming may in some embodiments produce an intermediate product configured to be subjected to additional operations to produce an atomizer, whereas in other embodiments pre-forming may produce the completed atomizer itself.

As illustrated, the apparatus 200 configured to pre-form atomizers may comprise a wick supply 202 configured to provide a substantially continuous wick 204. Further, the apparatus 200 may include a heating element supply 206 configured to provide a substantially continuous heating element 208. The apparatus 200 may additionally include a base 210 and a sliding carriage 212. The sliding carriage 212 may be configured to move with respect to the base 210. In particular, the sliding carriage 212 may be coupled to sliders 214 which are movable on tracks 216 coupled to the base 210.

Substantially continuous, as used herein to describe the heating element 208 and the wick 204, refers to a configuration in which the respective item (the heating element or the wick) extends substantially uninterrupted from a first end to a second end without interruption therebetween. For example, the wick supply 202 and/or the heating element supply 206 may define spools and the substantially continuous wick 204 and the substantially continuous heating element 208 may be wound thereon. In contrast, the term substantially continuous, as used herein, excludes segments of wick and heating element of the length ultimately employed in the final product. Thus, the term substantially continuous refers to the elongated configuration of the wick and heating element inputs that exceeds the length of the wick and heating element ultimately produced therefrom and incorporated into an atomizer.

Further, the apparatus 200 configured to pre-form atomizers may include a coiling apparatus 218. The coiling apparatus 218 may include a winding mechanism 220, an adjustment mechanism 222, and a synchronization mechanism 224. As described in detail below, the winding mechanism 220 may be configured to wind the substantially continuous heating element 208 about the substantially continuous wick 204. The adjustment mechanism 222 may be configured to adjust a position at which the winding mechanism 220 winds the substantially continuous heating element 208 about the substantially continuous wick 204. Further, the synchronization mechanism 224 may be configured to synchronize winding the substantially continuous heating element 208 about the substantially continuous wick 204 with adjustment of the position at which the substantially continuous heating element is wound about the substantially continuous wick such that the substantially continuous heating element defines a coiled heating element segment wound about the substantially continuous wick. Accordingly, as described in detail below, the substantially continuous heating element 208 may define a coiled heating element segment wound about the substantially continuous wick 204.

The coiling apparatus 218 may further include a heating element feeder 226. The heating element feeder 226 may be configured to position the substantially continuous heating element 208 in proximity to the substantially continuous wick 204. In one embodiment the heating element feeder 226 may comprise a hollow needle 228 (see, e.g., FIG. 5) configured to receive the continuous heating element 208 therethrough. Further, the heating element feeder 226 may be movable toward and away from the substantially continuous wick 204, as indicated by arrow 230 in FIG. 3. In this regard, the heating element feeder 226 may include a slider 232 which is movable on a track 234. Thereby, the heating element feeder 226 may be retracted away from the substantially continuous wick 204 such that the continuous heating element 208 may be cut between the hollow needle 228 and the substantially continuous wick to form a coiled heating element segment, as will be discussed below.

In operation, the substantially continuous wick 204 may be directed through the winding mechanism 220 and tensioned proximate the winding mechanism by a tensioning mechanism. Tensioning the substantially continuous wick 204 may facilitate wrapping the substantially continuous heating element 208 thereabout. In the illustrated embodiment clamps 236 may be employed to hold the substantially continuous wick 204 in a tensioned configuration. The clamps 236 may be bolted to the sliding carriage 212 such that the clamps and the substantially continuous wick 204 move therewith.

The winding mechanism 220 may comprise a winding head 238. As illustrated in FIG. 4, the winding head 238 may comprise a substantially cylindrical body 240, although various other shapes may be employed. A hole 242 may be defined in the winding head 238 extending along a central rotational axis of the body 240 of the winding head. Further, the winding head 238 may define a notch 244. The notch 244 may be defined at an end 246 of the body 240 of the winding head 238. The notch 244 may extend from the hole 242 to the perimeter of the body 240 in some embodiments.

As illustrated in FIG. 5, which is an enlarged view of inset A from FIG. 3, the substantially continuous wick 204 may be received through the hole 242 in the winding head 238. Further, the substantially continuous heating element 208 may be directed through the hollow needle 228 of the heating element feeder 226, which may position the substantially continuous heating element proximate the substantially continuous wick 204 and the winding head 238. Thereby, the notch 244 in the winding head 238 or other engagement mechanism defined by or coupled to the winding head may releasably engage the substantially continuous heating element 208 proximate an end 208*a* thereof. In this regard, a magnet 245 may be additionally or alternatively employed to secure the end 208*a*' of the substantially continuous heating element 208 against a side of the winding head 238.

Accordingly, by engaging the substantially continuous heating element 208, the winding head 238 may be rotated to wind the substantially continuous heating element about the substantially continuous wick 204. In order to start winding about the substantially continuous wick 204, the winding head 238 may initially be rotated to a starting position wherein the notch 244 is positioned on an opposite side of the substantially continuous wick relative to the heating element feeder 226 including the hollow needle 228. Thereby the end 208*a* of the substantially continuous heating element 208 may be directed either over (in the case of clockwise rotation of the winding head) or under (in the case of counterclockwise rotation of the winding head) the substantially continuous wick 204, in terms of the perspective illustrated in FIG. 5, and the notch 244 may engage the substantially continuous heating element proximate the end 208*a* thereof.

In order to position the hollow needle 228 at a desired position relative to the substantially continuous heating element, the heating element feeder 226 may be moved toward or away from the substantially continuous wick 204 in the manner described above. In some embodiments the track 234 and/or the slider 232 may define a stop that prevents the hollow needle 228 from extending into contact with, or past, the substantially continuous wick 204. Further, the hollow needle 228 may be mounted to the slider 232 via an adjustment mechanism 248. As illustrated in FIG. 3, the adjustment mechanism 248 may include slots 250 that allow for adjustment of the position of the hollow needle 228 in a direction parallel to the rotational axis of the winding head 238.

Further, a height of the hollow needle 228 may be adjusted by adjusting the height of a movable arm 252 defined by the adjustment mechanism 248, through which the hollow needle may extend. In one example embodiment, the moveable arm 252 may include a threaded hole and a bolt 254 received therethrough, as illustrated in FIG. 5. The end of the bolt 254 may engage a contact surface or an additional threaded hole, such that rotating the bolt 254 moves the moveable arm 252 and the hollow needle 228 up or down, depending on the direction of rotation of the bolt. Accordingly the position of the hollow needle 228 relative to the substantially continuous wick 204 may be adjusted.

By directing the substantially continuous heating element 208 through the hollow needle 228 and coupling the substantially continuous heating element 208 to the winding head 238 in the manner described above, rotation of the winding head about the rotational axis along which the hole 242 extends may wrap the substantially continuous heating element about the substantially continuous wick 204. As illustrated in FIG. 3, in one embodiment the winding mechanism 220 may be operably engaged with a hand crank 256, such that rotation of the hand crank 256 causes the winding head 238 to rotate as described above. However, in an alternate embodiment the winding mechanism 220 may be operably engaged with a motor 258 (see, e.g., FIG. 6).

FIG. 6 illustrates a partial view of the apparatus 200 configured to pre-form atomizers with a cover 260 (see, e.g., FIG. 3) for the coiling apparatus 218 and various other parts removed therefrom for clarity purposes. As noted above, the winding mechanism 220 may be operably engaged with a rotational power source such as the hand crank 256 or the motor 258. As illustrated, the adjustment mechanism 222 and the synchronization mechanism 224 may also be operably engaged with the rotational power source.

More particularly, the rotational power source may drive an input shaft 262. The input shaft 262 may be operatively engaged with a winding shaft 264, to which the winding head 238 is coupled. For example, a first bevel gear 266 may be coupled to the input shaft 262, and a second bevel gear 268 may be coupled to the winding shaft 264 and intermeshed with the first bevel gear. Accordingly, rotation of the input shaft (e.g., by the hand crank 256 or the motor 258) may transfer rotary motion to the winding head 238 to cause the substantially continuous heating element 208 to wind about the substantially continuous wick 204, as described above. In this regard, the winding shaft 264 may be hollow and configured to receive the substantially continuous wick 204 therethrough along a rotational axis thereof, which may be coaxial with the rotational axis of the winding head 238.

The cover 260 (see, e.g., FIG. 3) may combine with first and second walls 270, 272 to define a housing for all or a portion of the coiling apparatus 218. A first bearing 274 may support the input shaft 262 at the cover 260. A second bearing 276 may support the winding shaft 264 at the first wall 270 and a third bearing 278 may support the winding shaft 264 at the second wall 272. Note that bushings may be employed instead of bearings in other embodiments. Accordingly, rotation by a rotational power source such as the hand crank 256 or the motor 258 may cause the winding mechanism 220 to wind the substantially continuous heating element 208 about the substantially continuous wick 204, as described above.

As further described above, the coiling apparatus 218 may include the adjustment mechanism 222, which may be configured to adjust a position along a longitudinal axis of the substantially continuous wick 204 at which the winding mechanism 220 winds the substantially continuous heating element 208 about the substantially continuous wick. In this regard, as illustrated in FIG. 7, the adjustment mechanism 222 may comprise a cam 280 and a follower 282. The cam 280 may define cam surface 284 which defines an increasing radius extending from a starting point 284*a* to an ending point 284*b*. The difference between the radius at the starting point 284*a* and the ending point 284*b* of the cam surface 284 is equal to the width of a radially extending step 284*c* positioned between the starting point and the ending point. The follower 282 may define a head 286 configured to press against the cam surface 284. Thereby, as the cam 280 rotates in a counterclockwise direction in terms of the orientation illustrated in FIG. 7, the follower 282 may be displaced to the right (in terms of the illustrated orientation) as the cam surface 284 moves from contact with the head 286 of the follower at the starting point 284*a* to the ending point 284*b*.

As illustrated in FIG. 6, the follower 282 may be coupled to the sliding carriage 212 by a coupler 288. Accordingly, as the follower 282 is displaced to the right by the cam 280, the sliding carriage 212 may also be displaced to the right. In this regard, the sliding carriage 212, the sliders 214, and the tracks 216 may comprise portions of the adjustment mechanism 222. The heating element feeder 226 may be coupled to one or both of the coupler 288 and the sliding carriage 212. Further, as described above, the clamps 236 may be coupled to the sliding carriage 212 and the clamps may engage the substantially continuous wick 204. Accordingly, as the follower 282 is displaced to the right by the cam 280, the heating element feeder 226 and the substantially continuous wick 204 may also be displaced to the right. Thereby, a position along a longitudinal axis of the substantially continuous wick 204 at which the winding mechanism 220 winds the substantially continuous heating element 208 about the substantially continuous wick may be adjusted based on movement of the follower 282 due to relative longitudinal movement between the winding head 238 and the substantially continuous wick 204. By engaging the end 208A of the substantially continuous heating element 208 with the winding head 238 and moving the substantially continuous wick 204 and the heating element feeder 226 axially away therefrom, the substantially continuous heating element is coiled and cinched about the substantially continuous wick in a manner that may provide for relatively tight engagement therebetween. This configuration may provide for increased heat transfer from the resistive heating element to the wick in the finished form of the atomizer produced therefrom.

As noted above, the synchronization mechanism 224 may be configured to synchronize winding the substantially continuous heating element 208 about the substantially continuous wick 204 by the winding mechanism 220 with adjustment of the position along the longitudinal axis of the substantially continuous wick at which the winding mechanism winds the substantially continuous heating element about the substantially continuous wick by the adjustment mechanism 222 such that the substantially continuous heating element defines a coiled heating element segment wound about the substantially continuous wick. In this regard, in the illustrated embodiment the synchronization mechanism 224 comprises a first timing gear 290 coupled to the input shaft 262 and a second timing gear 292 coupled to the cam 280. A timing belt 294 or chain may rotatably couple the first timing gear 290 to the second timing gear 292 such that rotation of the input shaft 262 is transferred to the cam 280. Accordingly, when the rotational power source (see, e.g., the hand crank 256 or the motor 258) rotates the input shaft 262, both the winding mechanism 220 and the adjustment mechanism 222 operate as a result of the synchronization mechanism 224 providing operative engagement therebetween.

The timing belt 294 may be timed with respect to the first timing gear 290 and the second timing gear 292 such that when the head 286 of the follower 282 is positioned against the starting point 284*a* on the cam surface 284, the notch 244 in the winding head 238 is positioned such that the substantially continuous wick 204 is between the notch and the hollow needle 228 of the heating element feeder 226. Accordingly, the winding head 238 is positioned for receiving the substantially continuous heating element 208 in the notch 244 when the cam 280 is positioned at the beginning of its rotational cycle relative to the follower 282. Accordingly, the winding and displacement operations may be timed appropriately to function as described above.

After a desired number of rotations of the substantially continuous heating element 208 about the substantially continuous wick 204, the substantially continuous heating element may be cut. In one embodiment a user may manually employ a pair of clippers or scissors to cut the substantially continuous heating element 208. In this regard, the slider 232 may slide on the track 234 to allow the heating element feeder 226 to be moved to an outward position whereby access to the substantially continuous heating element 208 is provided. More particularly, movement of the heating element feeder 226 to the outward position allows the user to cut the substantially continuous heating element 208 between the hollow needle 228 and the substantially continuous wick 204. In another embodiment, as illustrated in FIG. 6, a cutting mechanism 296 may optionally by employed to automatically cut the substantially continuous heating element 208 after winding a desired number of rotations of the substantially continuous heating element about the substantially continuous wick 204. Further, the end 208*a* of the substantially continuous heating element 208 may be removed from the notch 244 in the winding head 238 or otherwise disengaged from the winding head.

Accordingly, as illustrated in FIG. 8, a resistive heating element 300 may be produced by winding the substantially continuous heating element 208 (see FIG. 5) about the substantially continuous wick 204. The resistive heating element 300 may comprise a coiled heating element segment 302 and first and second leads 304, 306 extending therefrom. The first lead 304 may correspond to the portion of the substantially continuous heating element 208 retained in the notch 244 in the winding head 238 or otherwise engaged therewith. The second lead 306 may correspond to the length of the substantially continuous heating element 208 between the substantially continuous wick 204 and the location at which the substantially continuous heating element is cut.

Due to the winding mechanism 220 winding the substantially continuous heating element 208 about the substantially continuous wick 204 at the same time that the adjustment mechanism 222 displaces the substantially continuous wick 204 along the longitudinal axis thereof, the coiled heating element segment 302 may define a substantially helical configuration. The spacing of the coils of the coiled heating element segment 302 may depend upon the cam surface 284 defined by the cam 280. In this regard, the cam surface 284 may define a constant increase in radius between the starting point 284*a* and the ending point 284*b* such that the coils are equally spaced apart (i.e. the coils are separated from one another such that there are equal distances therebetween). Further, the greater the length of the step 284*c*, the greater the spacing of the coils of the coiled heating element segment 302. In one embodiment the step 284*c* may define a length of about 0.06 inches, although various other lengths may be employed in other embodiments.

Additionally, the rotational speed of the winding head 238 versus the rotational speed of the cam 280 also affects the spacing of the coils of the coiled heating element segment 302. In this regard, the gear ratios defined by the gears 266, 268, 290, 292 may control the relative rotational speeds of the winding head 238 and the cam 280. For example, by increasing the size of the first timing gear 290 and/or decreasing the size of the second timing gear 292, the rotational speed of the cam 280 may be increased relative to the rotational speed of the winding head 238. Accordingly, by changing one or more of the gears 266, 268, 290, 292, and/or the cam 280, the spacing of the coils of the coiled heating element segment 302 may be adjusted. In one embodiment, six rotations of the hand crank 256 (or the motor 258) may result in six rotations of the winding head 238 and one revolution of the cam 280. In other words, the bevel gears 266, 268 may define a one to one gear ratio, and the first and second timing gears 290, 292 may define a six to one gear ratio. However, various other gear ratios may be employed in other embodiments. In each of the embodiments one rotation of the cam 280 may produce one coiled heating element segment 302, with the coiled heating element segment 302 defining a length substantially equal to the length of the step 284*c*.

After completion of the resistive heating element 300, the apparatus 200 configured to pre-form atomizers may be reset to the starting configuration to form an additional resistive heating element 300' (see FIG. 8), and this process may be iteratively repeated. In this regard, the clamps 236 may be released, and the substantially continuous wick 204 may be incremented to the right (in terms of the orientation illustrated in FIG. 6) to a new starting winding position along the longitudinal axis of the substantially continuous wick. As such, the forming of the resistive heating element may be defined in that the substantially continuous heating element 208 is supplied to the substantially continuous wick 204 by the heating element feeder 226 at a position that is stationary with respect to the substantially continuous wick (e.g., stationary with respect to a longitudinal position thereon), and such position moves away from the position at which the winding head 236 winds the substantially continuous heating element about the substantially continuous wick. Further, the sliding carriage 212 and the heating element feeder 226 may be slid back to left to the starting configuration in which the follower 282 contacts the starting point 284*a* on the cam surface 284. In one embodiment the sliding carriage 212 and the heating element feeder 226 may be manually slid back to the starting orientation. However, in another embodiment the sliding carriage 212 and/or the heating element feeder 226 may be configured to automatically return to the starting configuration.

For example, FIG. 5 illustrates a spring 298 that connects the heating element feeder 226 to the second wall 272, which biases the follower 282 against the cam 280 such that the adjustment mechanism 222 automatically returns to the starting configuration after the head 286 of the follower passes the ending point 284*b* on the cam surface 284. However, the follower 282, the coupler 288, and/or the sliding carriage 212 may be spring biased in other embodiments. Accordingly, the heating element feeder 226 may then be slid back into proximity with the substantially continuous wick 204 (perpendicularly to the axis of the substantially continuous wick), a new end 208A of the substantially continuous heating element 208 may be engaged with the notch 244 in the winding head 238, and the various winding operations described above may be repeated.

As illustrated in FIG. 3, the substantially continuous wick 204 with the resistive heating elements 300 positioned thereon may be collected on a collection reel 299. Thereafter, the substantially continuous wick 204 with the resistive heating elements 300 positioned thereon may substantially define completed atomizers or may be subjected to one or more additional operations to complete production of atomizers. In this regard, by retaining the continuity of the substantially continuous wick 204, the substantially continuous wick may be employed to facilitate the additional operations as opposed to requiring handling and transport of individual sections of wick and heating elements. The heating elements can be spaced on the substantially continuous wick such that the wicks can be cut at uniform spacing to free individual atomizers for direct insertion into a smoking article. Such further processing can be manual or automated.

A method for pre-forming an atomizer is also provided. As illustrated in FIG. 9, the method may include providing a substantially continuous wick at operation 400 and providing a substantially continuous heating element at operation 402. Further, the method may include winding the substantially continuous heating element about the substantially continuous wick at operation 404. The method may also include adjusting a position at which the substantially continuous heating element is wound about the substantially continuous wick at operation 406. Additionally, the method may include synchronizing winding the substantially continuous heating element about the substantially continuous wick with adjustment of the position at which the substantially continuous heating element is wound about the substantially continuous wick at operation 408.

In some embodiments the method may further comprise directing the substantially continuous wick through a hole extending along a rotational axis of a winding head at operation 410. In some embodiments winding the substantially continuous heating element about the substantially continuous wick at operation 404 may comprise releasably engaging the substantially continuous heating element proximate an end thereof with the winding head. Further, the method may include cutting the substantially continuous heating element to define a resistive heating element comprising the coiled heating element segment at operation 412. Additionally, the method may include incrementing a starting winding position on the substantially continuous wick at operation 414. In some embodiments the substantially continuous heating element 208 may be supplied at a position that is stationary with respect to the substantially continuous wick. Further, such relative stationary positioning may be achieved with simultaneous longitudinal movement of both the substantially continuous wick 204 and the heating element feeder 226. However, the substantially continuous heating element 208 may be wound for a plurality of revolutions around the substantially continuous wick 204 without laying more than a single layer of the substantially continuous heating element at a single position on the substantially continuous wick. Rather, the substantially continuous heating element 208 may be biased rearward relative to the position at which the substantially continuous heating element is supplied to the substantially continuous wick 204 by the heating element feeder 226. As such, the substantially continuous heating element 208 may define coils spaced apart along the longitudinal length of the substantially continuous wick 204. The method may also include collecting the substantially continuous wick with the resistive heating element wound thereon on a collection reel at operation 416.

In an additional aspect, a controller configured to execute computer code for performing the above-described operations is provided. The controller may comprise a processor that may be a microprocessor or controller for controlling the overall operation thereof. In one embodiment the processor may be particularly configured to perform the functions described herein. The controller may also include a memory device. The memory device may include non-transitory and tangible memory that may be, for example, volatile and/or non-volatile memory. The memory device may be configured to store information, data, files, applications, instructions or the like. For example, the memory device could be configured to buffer input data for processing by the processor. Additionally or alternatively, the memory device may be configured to store instructions for execution by the processor.

The controller may also include a user interface that allows a user to interact therewith. For example, the user interface can take a variety of forms, such as a button, keypad, dial, touch screen, audio input interface, visual/image capture input interface, input in the form of sensor data, etc. Still further, the user interface may be configured to output information to the user through a display, speaker, or other output device. A communication interface may provide for transmitting and receiving data through, for example, a wired or wireless network such as a local area network (LAN), a metropolitan area network (MAN), and/or a wide area network (WAN), for example, the Internet.

The controller may also include an atomizer pre-forming module. The processor may be embodied as, include or otherwise control the atomizer pre-forming module. The atomizer pre-forming module may be configured for controlling or executing the atomizer pre-forming operations described herein.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling atomizer pre-forming operations. In this regard, a computer readable storage medium, as used herein, refers to a non-transitory, physical storage medium (e.g., a volatile or non-volatile memory device, which can be read by a computer system. Examples of the computer readable medium include read-only memory, random-access memory, CD-ROMs, DVDs, magnetic tape, and optical data storage devices. The computer readable medium can also be distributed over network-coupled computer systems so that the computer readable code is stored and executed in a distributed fashion.

Thus, an embodiment of a non-transitory computer readable medium for storing computer instructions executed by a processor in a controller for an apparatus configured to pre-form atomizers is provided. The non-transitory computer readable medium may comprise computer code for providing a substantially continuous wick, computer code for providing a substantially continuous heating element, computer code for winding the substantially continuous heating element about the substantially continuous wick, computer code for adjusting a position at which the substantially continuous heating element is wound about the substantially continuous wick, and computer code for synchronizing winding the substantially continuous heating element about the substantially continuous wick with adjustment of the position at which the substantially continuous heating element is wound about the substantially continuous wick such that the substantially continuous heating element defines a coiled heating element segment wound about the substantially continuous wick.

In some embodiments the non-transitory computer readable medium may further comprise computer code for cutting the substantially continuous heating element to define a resistive heating element comprising the coiled heating element segment. Further, the non-transitory computer readable medium may include computer code for incrementing a starting winding position on the substantially continuous wick. The non-transitory computer readable medium may additionally include computer code for collecting the substantially continuous wick with the resistive heating element wound thereon on a collection reel. In some embodiments the non-transitory computer readable medium may further comprise computer code for supplying the substantially continuous heating element at a position that is stationary with respect to the substantially continuous wick. The non-transitory computer readable medium may further comprise computer code for directing the substantially continuous wick through a hole extending along a rotational axis of a winding head. In some embodiments computer code for winding the substantially continuous heating element about the substantially continuous wick may comprise computer code for releasably engaging the substantially continuous heating element proximate an end thereof with the winding head.

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

The invention claimed is:

1. An apparatus configured to pre-form an atomizer, comprising:

a wick supply configured to provide a substantially continuous wick;

a heating element supply configured to provide a substantially continuous heating element;

a winding mechanism configured to wind the substantially continuous heating element about the substantially continuous wick;

an adjustment mechanism configured to adjust a position at which the winding mechanism winds the substantially continuous heating element about the substantially continuous wick; and a synchronization mechanism configured to synchronize winding the substantially continuous heating element about the substantially continuous wick with adjustment of the position at which the substantially continuous heating element is wound about the substantially continuous wick such that the substantially continuous heating element defines a coiled heating element segment wound about the substantially continuous wick.

2. The apparatus of claim 1, further comprising a cutting mechanism configured to cut the substantially continuous heating element to define a resistive heating element comprising the coiled heating element segment.

3. The apparatus of claim 2, further comprising a collection reel configured to collect the substantially continuous wick with the resistive heating element wound thereon.

4. The apparatus of claim 1, further comprising a heating element feeder configured to position the substantially continuous heating element in proximity to the substantially continuous wick.

5. The apparatus of claim 4, wherein the heating element feeder comprises a hollow needle.

6. The apparatus of claim 4, wherein the heating element feeder is moveable toward and away from the substantially continuous wick.

7. The apparatus of claim 1, wherein the winding mechanism, the adjustment mechanism, and the synchronization mechanism are operably engaged with a hand crank.

8. The apparatus of claim 1, wherein the winding mechanism, the adjustment mechanism, and the synchronization mechanism are operably engaged with a motor.

9. The apparatus of claim 1, wherein the winding mechanism comprises a winding head configured to rotate about a rotational axis.

10. The apparatus of claim 9, wherein the winding head defines a hole therethrough extending along the rotational axis through which the substantially continuous wick is received.

11. The apparatus of claim 9, wherein the winding head comprises an engagement mechanism configured to releasably engage the substantially continuous heating element proximate an end thereof.

12. The apparatus of claim 11, wherein the engagement mechanism comprises a notch defined in the winding head.

13. The apparatus of claim 1, further comprising a tensioning mechanism configured to tension the substantially continuous wick proximate the winding mechanism.

14. The apparatus of claim 1, wherein the adjustment mechanism comprises a sliding carriage configured for displacement with respect to the winding mechanism.

15. A method for pre-forming an atomizer, comprising:

providing a substantially continuous wick;

providing a substantially continuous heating element;

winding the substantially continuous heating element about the substantially continuous wick;

adjusting a position at which the substantially continuous heating element is wound about the substantially continuous wick; and synchronizing winding the substantially continuous heating element about the substantially continuous wick with adjustment of the position at which the substantially continuous heating element is wound about the substantially continuous wick such that the substantially continuous heating element defines a coiled heating element segment wound about the substantially continuous wick.

16. The method of claim 15, further comprising cutting the substantially continuous heating element to define a resistive heating element comprising the coiled heating element segment.

17. The method of claim 15, further comprising incrementing a starting winding position on the substantially continuous wick.

18. The method of claim 17, further comprising collecting the substantially continuous wick with the resistive heating element wound thereon on a collection reel.

19. The method of claim 15, wherein the substantially continuous heating element is supplied at a position that is stationary with respect to the substantially continuous wick.

20. The method of claim 15, further comprising directing the substantially continuous wick through a hole extending along a rotational axis of a winding head.

21. The method of claim 20, wherein winding the substantially continuous heating element about the substantially continuous wick comprises releasably engaging the substantially continuous heating element proximate an end thereof with the winding head.

22. An apparatus configured to pre-form an atomizer, comprising:

a wick supply configured to provide a substantially continuous wick;

a heating element supply configured to provide a substantially continuous heating element;

a winding mechanism configured to wind the substantially continuous heating element about the substantially continuous wick;

an adjustment mechanism configured to adjust a position at which the winding mechanism winds the substantially continuous heating element about the substantially continuous wick;

a synchronization mechanism configured to synchronize winding the substantially continuous heating element about the substantially continuous wick with adjustment of the position at which the substantially continuous heating element is wound about the substantially continuous wick such that the substantially continuous heating element defines a coiled heating element segment wound about the substantially continuous wick;

a cutting mechanism configured to cut the substantially continuous heating element to define a resistive heating element comprising the coiled heating element segment; and a collection reel configured to collect the substantially continuous wick with the resistive heating element wound thereon.

23. A method for pre-forming an atomizer, comprising:

providing a substantially continuous wick;

providing a substantially continuous heating element;

winding the substantially continuous heating element about the substantially continuous wick;

adjusting a position at which the substantially continuous heating element is wound about the substantially continuous wick; and synchronizing winding the substantially continuous heating element about the substantially continuous wick with adjustment of the position at which the substantially continuous heating element is wound about the substantially continuous wick such that the substantially continuous heating element defines a coiled heating element segment wound about the substantially continuous wick;

cutting the substantially continuous heating element to define a resistive heating element comprising the coiled heating element segment; and collecting the substantially continuous wick with the resistive heating element wound thereon on a collection reel.

* * * * *